US006844641B1

(12) United States Patent
Horng et al.

(10) Patent No.: US 6,844,641 B1
(45) Date of Patent: Jan. 18, 2005

(54) CASING FOR HEAT-DISSIPATING FAN

(75) Inventors: Alex Horng, Kaohsiung (TW); Yin-Rong Hong, Kaohsiung (TW); Ching-Sheng Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 10/799,623

(22) Filed: Mar. 15, 2004

(51) Int. Cl.[7] ..... H02K 5/00
(52) U.S. Cl. ..... 310/89
(58) Field of Search ..... 310/51, 58, 62, 310/63, 60 A, 40 R, 89, 59; 417/423.14

(56) References Cited

U.S. PATENT DOCUMENTS 5,019,735 A * 5/1991 Lee ..... 310/89
5,288,203 A * 2/1994 Thomas ..... 165/80.3
5,343,101 A * 8/1994 Matani ..... 310/58
5,407,324 A * 4/1995 Starnes et al. ..... 415/208.5
5,583,746 A * 12/1996 Wang ..... 361/697
5,833,436 A * 11/1998 Ho ..... 416/247 R
5,982,064 A * 11/1999 Umeda et al. ..... 310/90
6,053,242 A * 4/2000 Hsieh ..... 165/121
6,132,171 A * 10/2000 Fujinaka et al. ..... 415/208.5
6,157,104 A * 12/2000 Yokozawa et al. ..... 310/58
6,179,561 B1 * 1/2001 Horng ..... 415/208.3
6,386,785 B1 * 5/2002 Horng ..... 403/14
6,547,540 B1 * 4/2003 Horng et al. ..... 417/423.14
6,561,762 B1 * 5/2003 Horng et al. ..... 415/211.2
6,565,326 B2 * 5/2003 Horng et al. ..... 417/44.1
6,568,905 B2 * 5/2003 Horng et al. ..... 415/206
6,568,907 B2 * 5/2003 Horng et al. ..... 416/185
6,572,346 B2 * 6/2003 Hsieh ..... 417/354
6,608,411 B2 * 8/2003 Horng et al. ..... 310/68 R
6,608,412 B2 * 8/2003 Horng et al. ..... 310/71
6,710,486 B1 * 3/2004 Horng et al. ..... 310/89
6,726,455 B2 * 4/2004 Horng et al. ..... 417/14

FOREIGN PATENT DOCUMENTS

GB 2379805 * 3/2003 ..... H02K/29/03
JP 06339243 * 12/1994 ..... H02K/5/04
JP 06339244 * 12/1994

* cited by examiner

*Primary Examiner*—Burton S. Mullins
*Assistant Examiner*—Heba Y. Elkassabgi
(74) *Attorney, Agent, or Firm*—Bacon & Thomas, PLLC

(57) ABSTRACT

A casing for a heat-dissipating fan includes an annular wall and a base. The annular wall includes an air inlet in a first end thereof and an air outlet in a second end thereof. The base is securely mounted in the air inlet of the base, with a plurality of ribs extending between the annular wall and the base. A plurality of mounting portions are provided between the annular wall and the base to allow the heat-dissipating fan to be fixed to an object. Since the mounting portions are located inside the annular wall, minimization of the casing is realized.

12 Claims, 13 Drawing Sheets

CASING FOR HEAT-DISSIPATING FAN

BACKGROUND OF THE INVENTION

1. Field of the Invention

The present invention relates to a casing for a heat-dissipating fan. In particular, the present invention relates to a smaller casing for a heat-dissipating fan.

2. Description of Related Art

FIG. 1 of the drawings illustrates a conventional heat-dissipating fan comprising a casing 10, a stator 20, and a rotor 30. The casing 10 includes an air inlet 11, and air outlet 12, a base 13, and a plurality of mounting holes 101. The rotor 30 is rotatably mounted to the stator 20, and the combined rotor 30/stator 20 is mounted on the base 13 of the casing 10. The mounting holes are provided in the corners 102 of the casing 10. After assembly of the rotor 30, stator 20, and the casing 10 to form a heat-dissipating fan product, the heat-dissipating fan is fixed above an object to be dissipated by means of extending fasteners 40 through the mounting holes 101.

U.S. patent application Ser. No. 10/340,787 discloses a heat-dissipating fan, which, as shown in FIG. 2, includes a casing 10, a stator 20, and a rotor 30. The casing 10 includes an annular wall 103 and a mounting plate 104. A plurality of slits 105 are defined in the annular wall 103 to increase the amount of inlet air. A plurality of mounting holes 101 are defined in the mounting plate 104, allowing the heat-dissipating fan to be fixed by fasteners 40 above an object to be dissipated.

U.S. Pat. No. 6,132,171 discloses a blower (i.e., a heat-dissipating fan) and a method for molding housing thereof. The blower comprises a casing body (mounting plate) and a plurality of annular plates spaced from each other and stacked in a direction along an axis of rotation of the fan to form a wall (casing) with slits. The slits increase the amount of inlet air. Similarly, a plurality of mounting holes are defined in the casing body, allowing the blower to be fixed above an object to be dissipated.

These heat-dissipating fans are widely used, as they may increase the amount of inlet air. Nevertheless, the mounting holes for fixing the heat-dissipating fan are located in the corners of the casing or of the mounting plate such that the size of the casing and the overall volume of the heat-dissipating fan cannot be effectively reduced. Thus, a larger space is required for mounting the heat-dissipating fan, causing a limitation to application of the heat-dissipating fan. Further, more amount of raw material is required for molding the casing of the heat-dissipating fan, resulting an increase in the manufacturing cost.

OBJECTS OF THE INVENTION

An object of the present invention is to provide a casing for reducing an overall volume of a heat-dissipating fan and for reducing the space for mounting the heat-dissipating fan.

Another object of the present invention is to provide a casing for a heat-dissipating fan that provides flexibility of assembling and design.

A further object of the present invention is to provide a casing for a heat-dissipating fan with an improved air-guiding effect.

SUMMARY OF THE INVENTION

In accordance with an aspect of the present invention, a casing for a heat-dissipating fan comprises an annular wall and a base. The annular wall includes an air inlet in a first end thereof and an air outlet in a second end thereof. The base is securely mounted in the air inlet of the base, with a plurality of ribs extending between the annular wall and the base. A plurality of mounting portions are provided between the annular wall and the base to allow the heat-dissipating fan to be fixed to an object.

In an embodiment of the invention, the mounting portions are integrally formed on the respective ribs. Each mounting portion is located in an adjoining area between the respective rib and the annular wall. A stator is securely mounted to the base and a rotor is rotatably mounted to the stator. The rotor includes a plurality of blades each having a cutout in an underside of an outer edge thereof to avoid contact with the mounting portions and the fasteners. Alternatively, each mounting portion is located in an adjoining area between the respective rib and the base.

In another embodiment of the invention, the annular wall includes an inner annular air-guiding ledge extending inward from an inner periphery thereof for guiding air from the air inlet side to the air outlet side, with the mounting portions being integrally formed on the inner annular air-guiding ledge.

Each mounting portion may be a through-hole for engaging with a fastener. Each through-hole may include a threaded portion for threadedly engaging with a threaded fastener. Each through-hole may include an enlarged portion for receiving an enlarged head of a fastener.

In a further embodiment of the invention, the casing further includes a bottom wall, and each mounting portion extends outward from the bottom wall for engaging with a fixing hole of a substrate. In a modified embodiment, a through-hole extends through each peg and through the bottom wall of the casing.

In still another embodiment of the invention, each rib includes an arcuate face on an air inlet side thereof, and the mounting portions are integrally formed on the respective ribs. In yet another embodiment of the invention, each rib further includes an inclined side face extending in a direction opposite to that of the blades.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
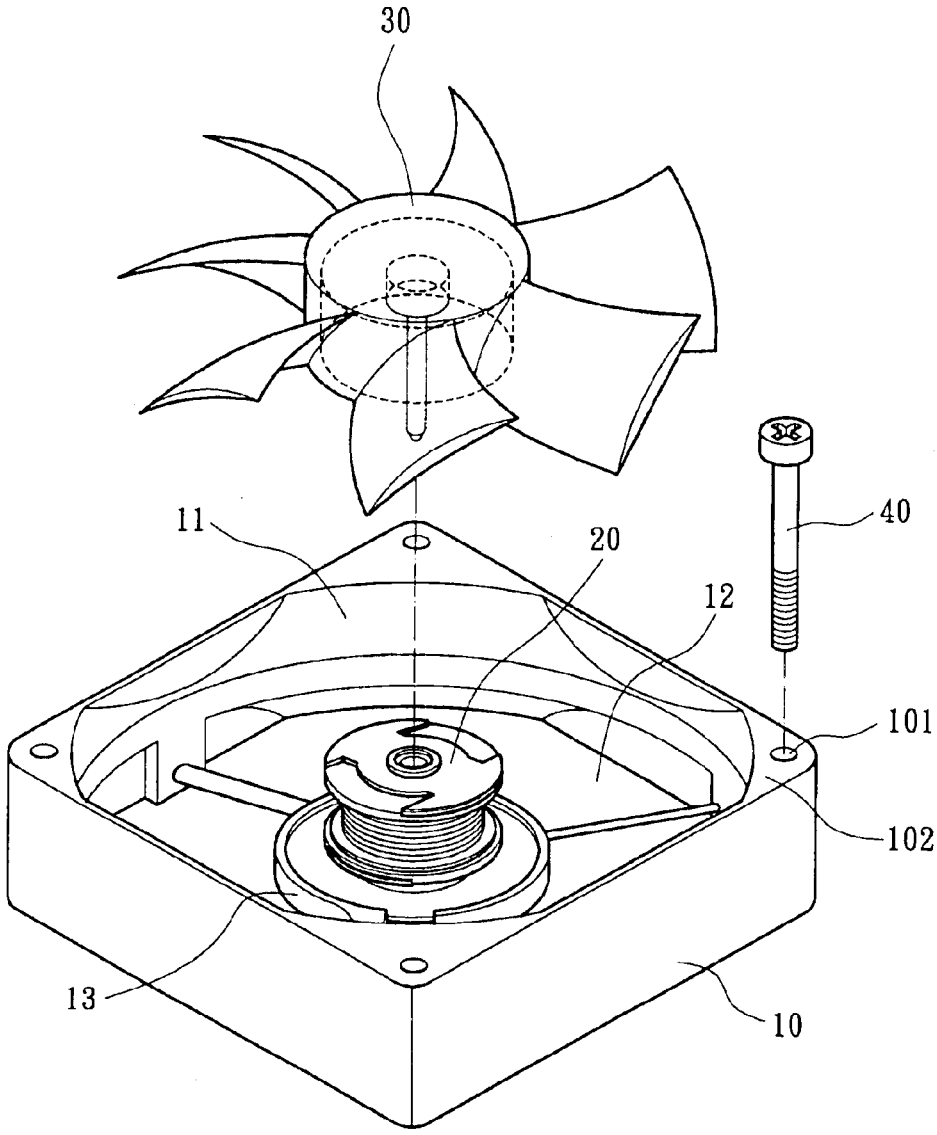
FIG. 1 PRIOR ART
FIG. 1 is an exploded perspective view of a conventional heat-dissipating fan.
Figure 2:
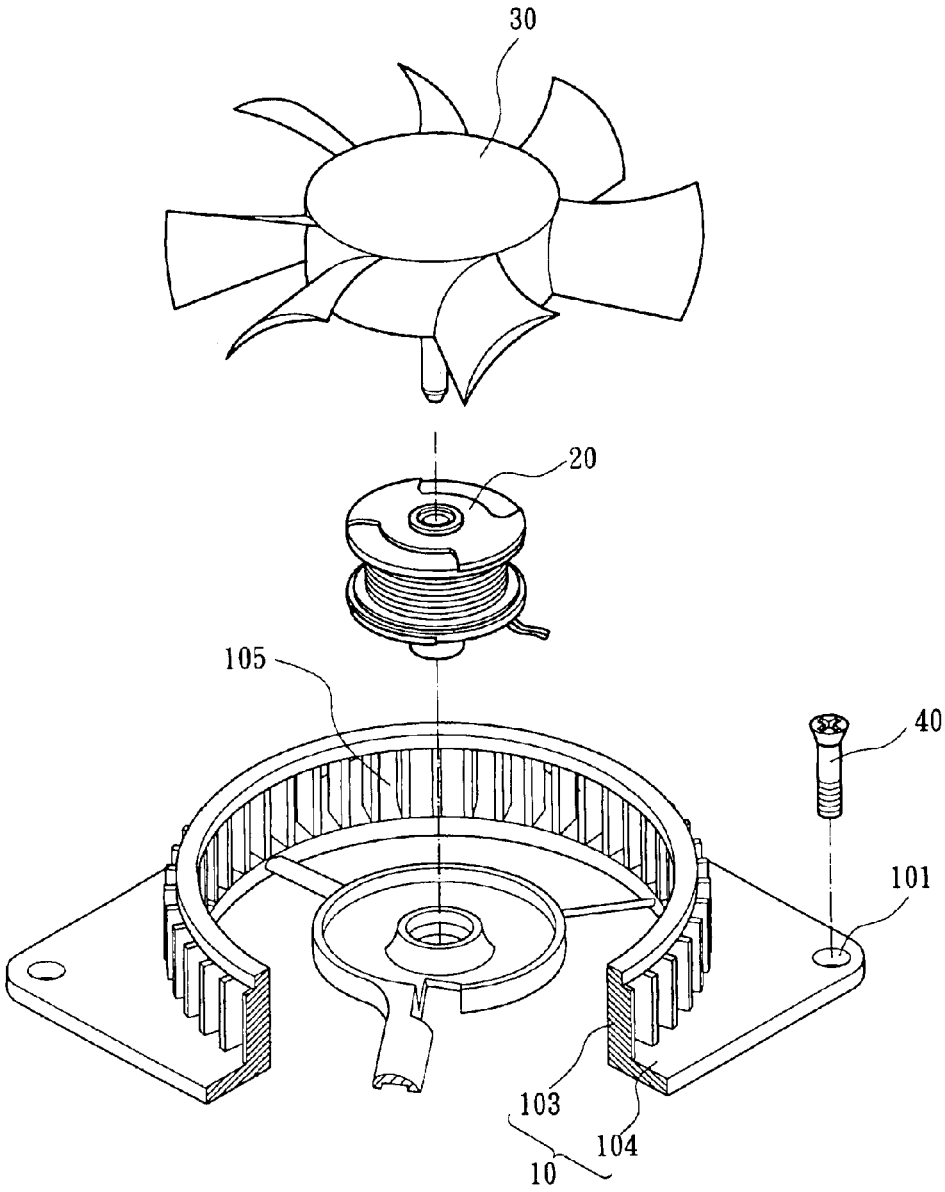
FIG. 2 PRIOR ART
FIG. 2 is an exploded perspective view of another conventional heat-dissipating fan.

Preferred embodiments of the present invention are now to be described hereinafter in detail, in which the same reference numerals are used in the preferred embodiments for the same parts as those in the prior art to avoid redundant description.

Figure 3:
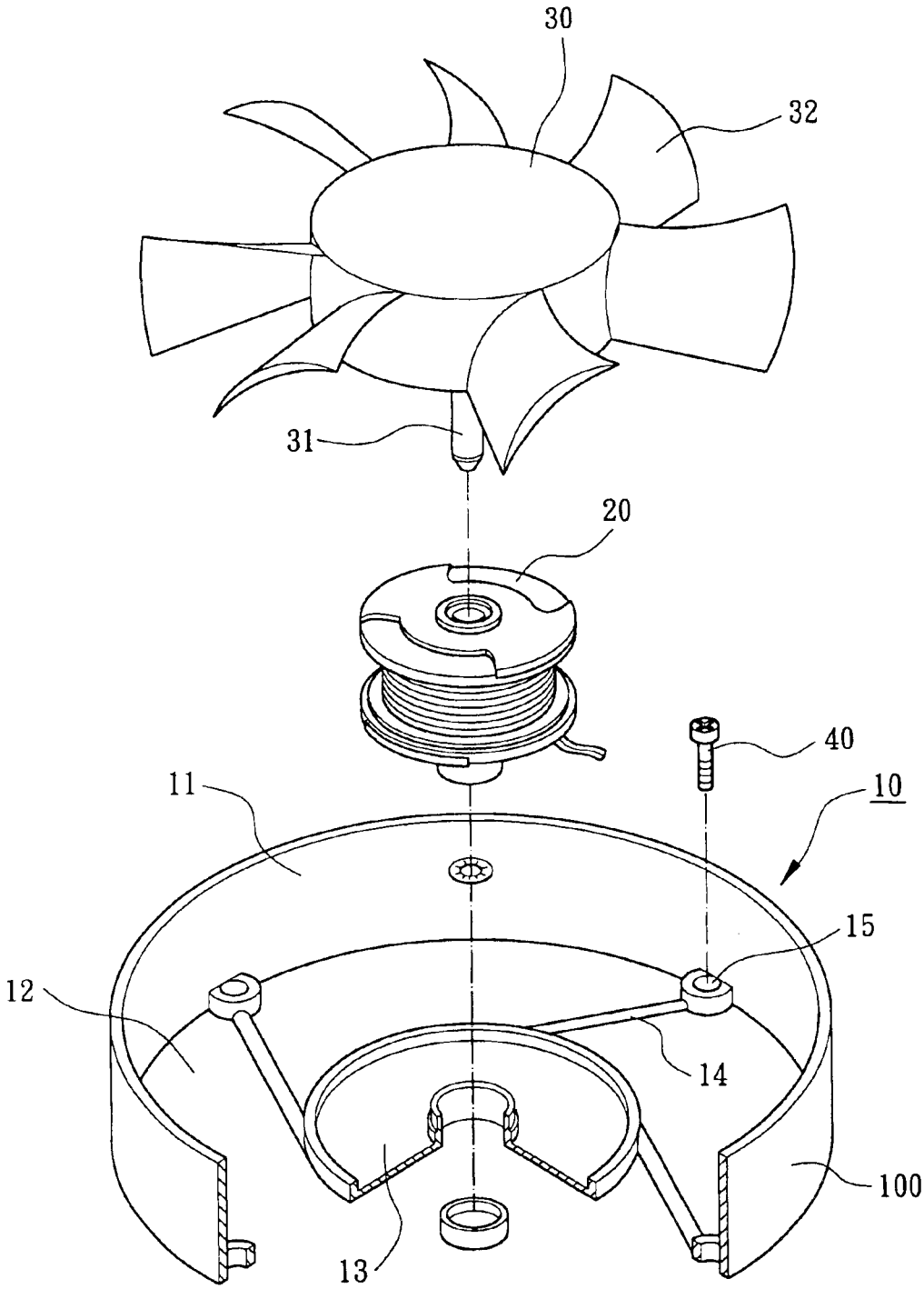
FIG. 3 is an exploded perspective view, partly cutaway, of a first embodiment of a heat-dissipating fan in accordance with the present invention.
Figure 4:
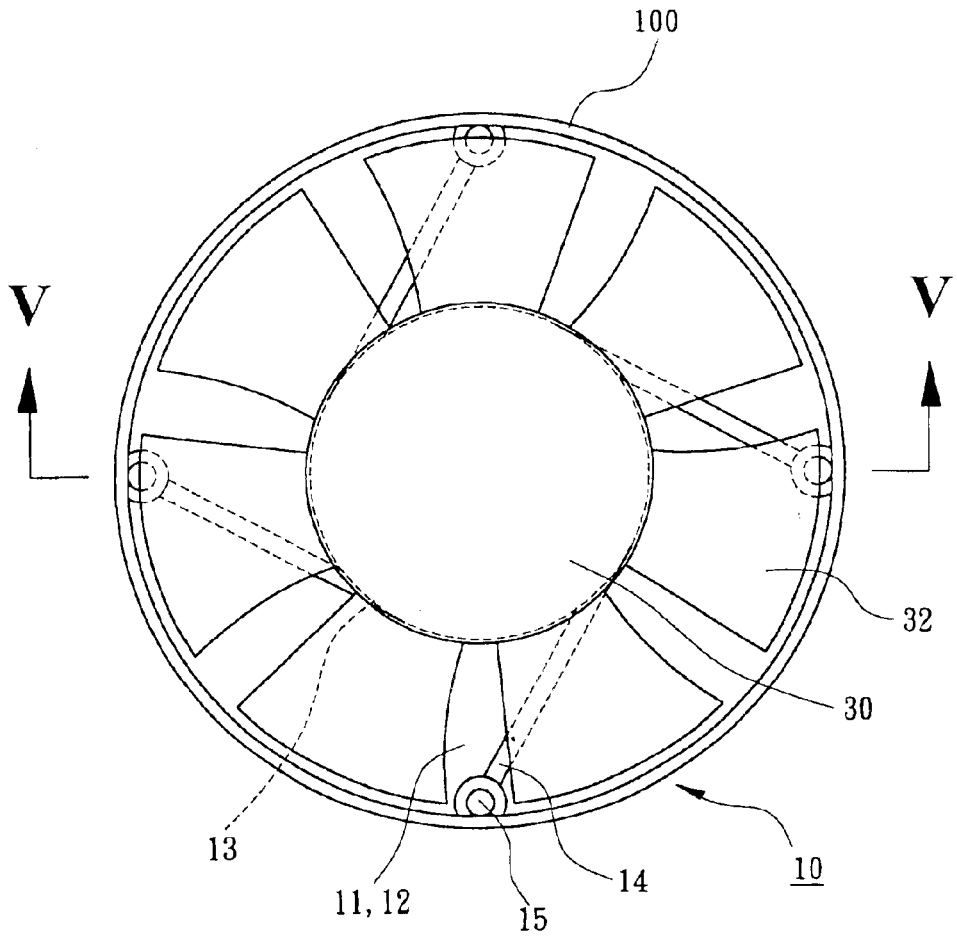
Figure 5:
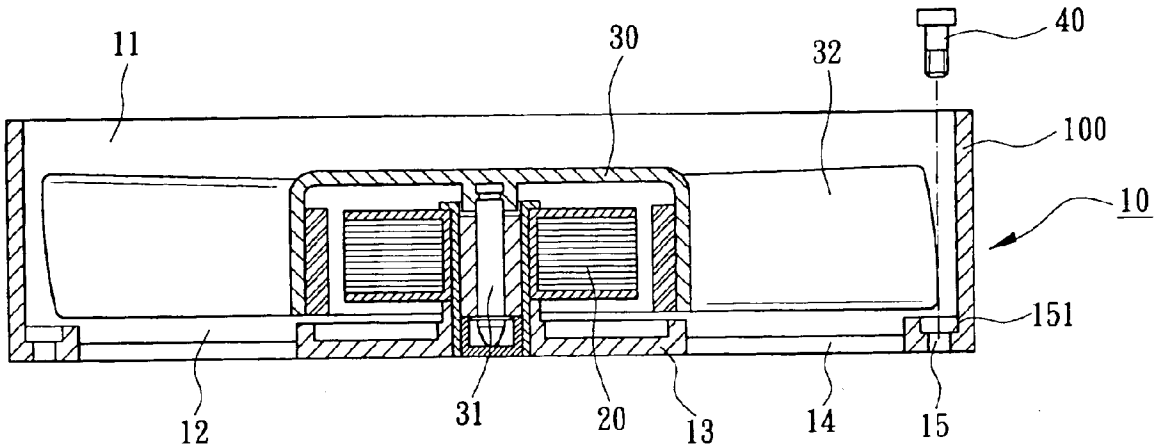
FIG. 5 is a sectional view taken along line V—V in FIG. 4.

Referring to FIGS. 3 through 5, a first embodiment of a heat-dissipating fan in accordance with the present invention comprises a casing 10 that includes an annular wall 100, an air inlet 11, an air outlet 12, a base 13, a plurality of ribs 14, and a plurality of mounting portions 15. The annular wall 100 defines a space having two opposing ends that respectively define the air inlet 11 and the air outlet 12. The base 13 is located in the air outlet 12 and securely connected by the ribs 14 to the annular wall 100.

A stator 20 and a rotor 30 are mounted to the base 13. The rotor 30 includes a shaft 31 rotatably received in the stator 20 and a plurality of blades 32 for driving air. The mounting portions 15 are provided between the annular wall 100 and the base 13 at appropriate locations. Preferably, the mounting portions 15 are integrally formed on the ribs 14. Preferably, each mounting portion 15 is located in an adjoining area between a respective rib 14 and the annular wall 100. In this embodiment, each mounting portion 15 is a through-hole extending through the respective rib 14. A fastener 40 such as a bolt, screw, etc may be extended through the mounting portion 15 in the respective rib 14, thereby mounting the heat-dissipating fan to a desired place. Further, as illustrated in FIG. 5, the mounting portion 15 has a stepped section or an enlarged section 151 for receiving an enlarged head (not labeled) of the fastener 40. Thus, the enlarged head of the respective fastener 40 will not interfere with rotation of the blades 32.

Referring to FIGS. 4 and 5, after the casing 10, the stator 20, and the rotor 30 are assembled to form a heat-dissipating fan product, the heat-dissipating fan is fixed by the fasteners 40 above an object (e.g., a heat sink fixed on an integrated circuit (not shown) to be dissipated. The fasteners 40 may be mounted via the air inlet side 11 (the upper side in FIG. 5). More specifically, each fastener 40 is passed through a gap between two adjacent blades 32 and then extended through the respective mounting portion 15 and into a coupling hole (not shown) of the object to be dissipated. Since the mounting portions 15 are located inside the annular wall 100 of the casing 10, the size of the casing 10 can be effectively reduced. Thus, minimization of the heat-dissipating fan can be realized, and the space required for mounting the heat-dissipating fan is reduced. Further, an overall axial length of the respective mounting portion 15 and its associated fastener 40 is preferably smaller or equal to that of the base 13. Interference with the rotation of the blades 32 of the rotor 30 by the mounting portions 15 and/or the fasteners 40 is avoided. The air-driving efficiency is assured.

Figure 6:
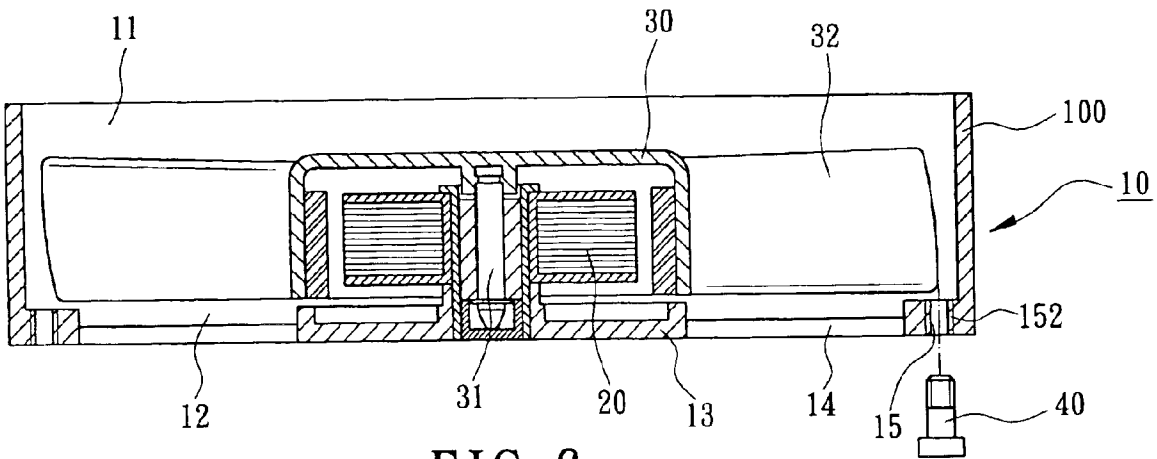
FIG. 6 is a sectional view similar to FIG. 5, illustrating a second embodiment of the heat-dissipating fan in accordance with the present invention.

FIG. 6 shows a second embodiment of the heat-dissipating fan in accordance with the present invention, wherein each mounting portion 15 includes a threaded portion 152 for improving flexibility of assembling and design. Due to the threaded portion 152, the respective fastener 40 can be mounted via the air inlet side or the air outlet side (the lower side in FIG. 6) for fixing the heat-dissipating fan to an object to be dissipated.

Figure 7:
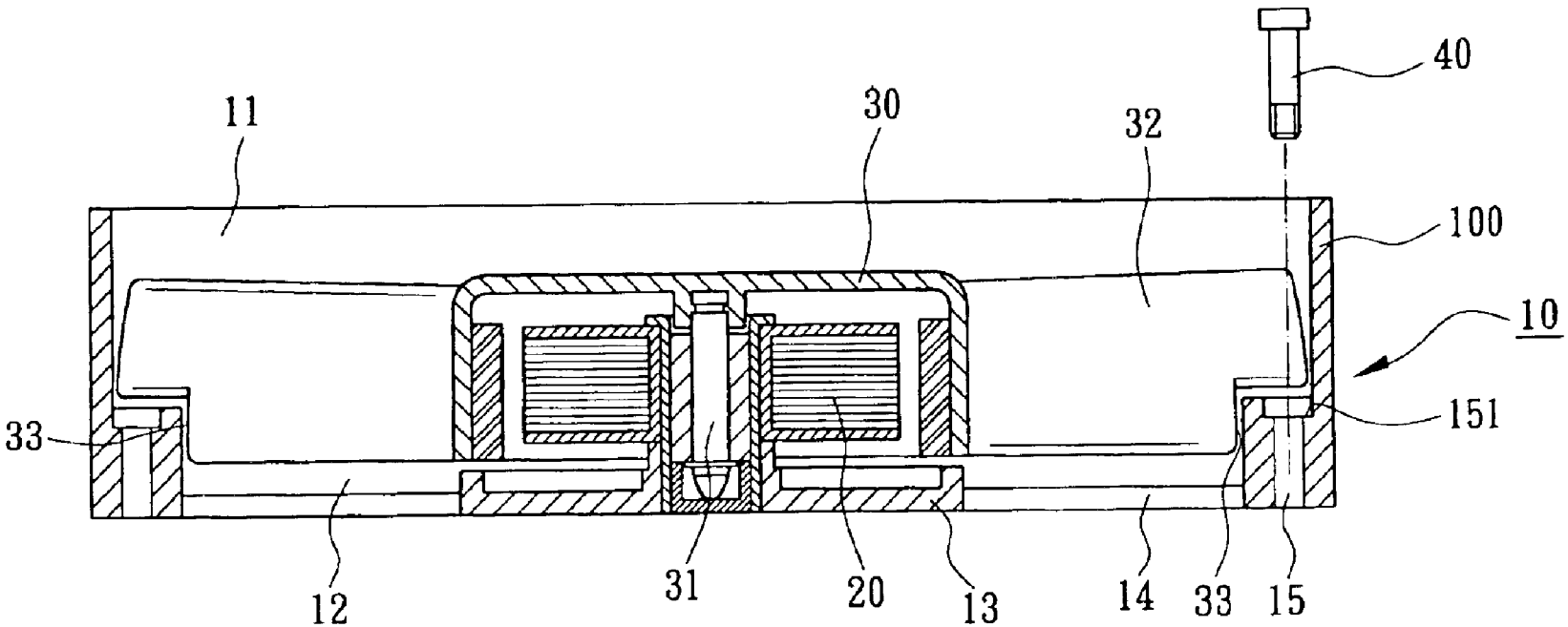
FIG. 7 is a sectional view similar to FIG. 5, illustrating a third embodiment of the heat-dissipating fan in accordance with the present invention.

FIG. 7 illustrates a third embodiment of the heat-dissipating fan in accordance with the present invention. In this embodiment, the axial length of the respective mounting portion 15 is larger than that of the base 13 as compared to the embodiment of FIG. 3. Further, each blade 32 of the rotor 30 includes a cutout 44 in an underside of an outer edge thereof to avoid contact with the mounting portions 15. Further, an outer edge of each blade 32 is as close to an inner periphery of the annular wall 100 as possible. Thus, longer fasteners 40 can be used and extended through the mounting portions 15 to provide more reliable fixing of the heat-dissipating fan without adversely affecting rotation of the blades 32. Thus, the assembling reliability of the heat-dissipating fan is improved.

Figure 8:
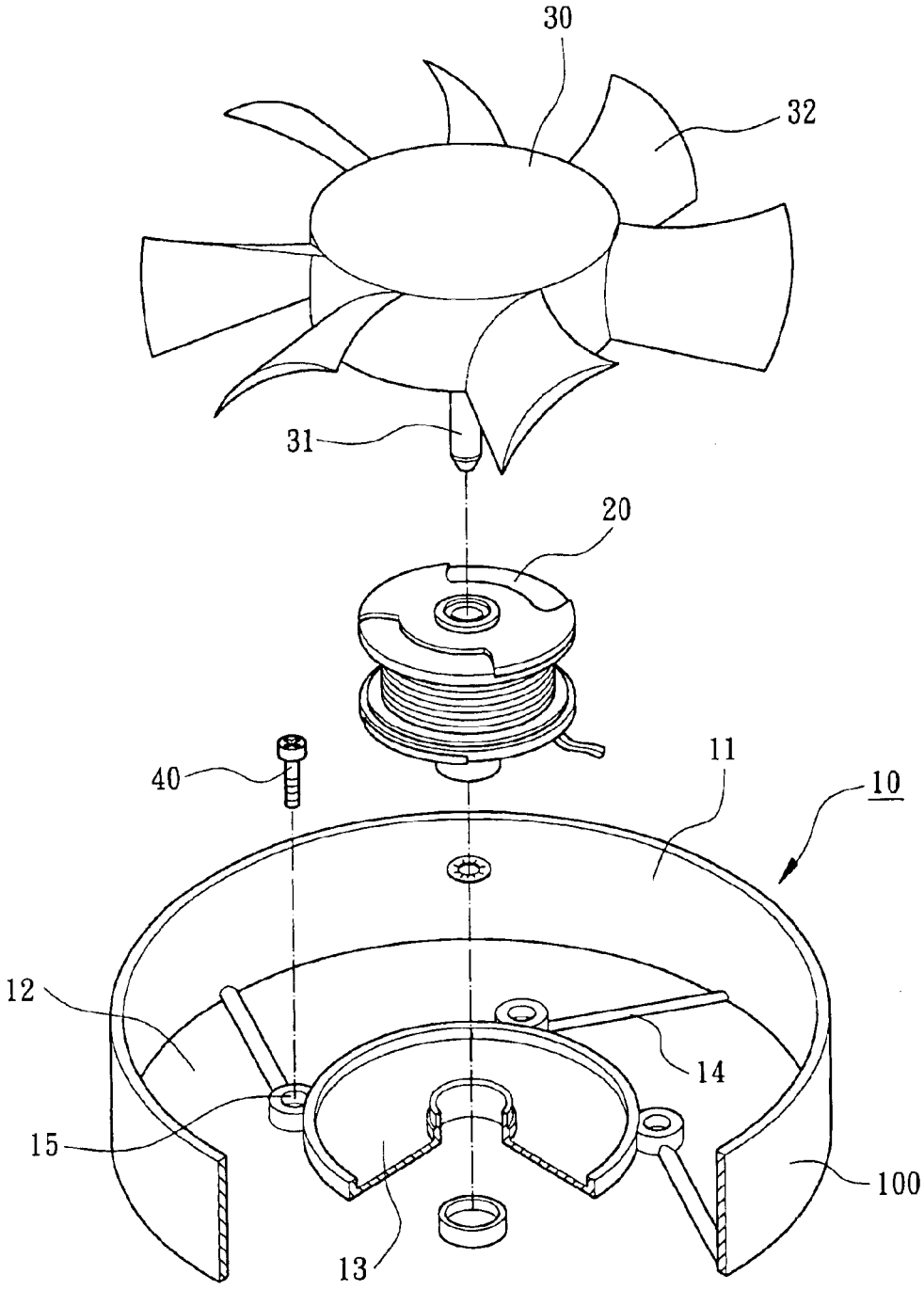
FIG. 8 is an exploded perspective view, partly cutaway, of a fourth embodiment of the heat-dissipating fan of in accordance with the present invention.

FIG. 8 illustrates a fourth embodiment of the heat-dissipating fan in accordance with the present invention. In this embodiment, each mounting portion 15 is located in an adjoining area between the respective rib 14 and he base 13, allowing a fastener 40 to extend from an upper side or an underside through the mounting portion 15. The size of the casing 10 is reduced. Minimization of the heat-dissipating fan is realized, and the space required for mounting the heat-dissipating fan is reduced. Thus, flexibility of assembling and design is improved through a change in the locations of the mounting portions 15.

Figure 9:
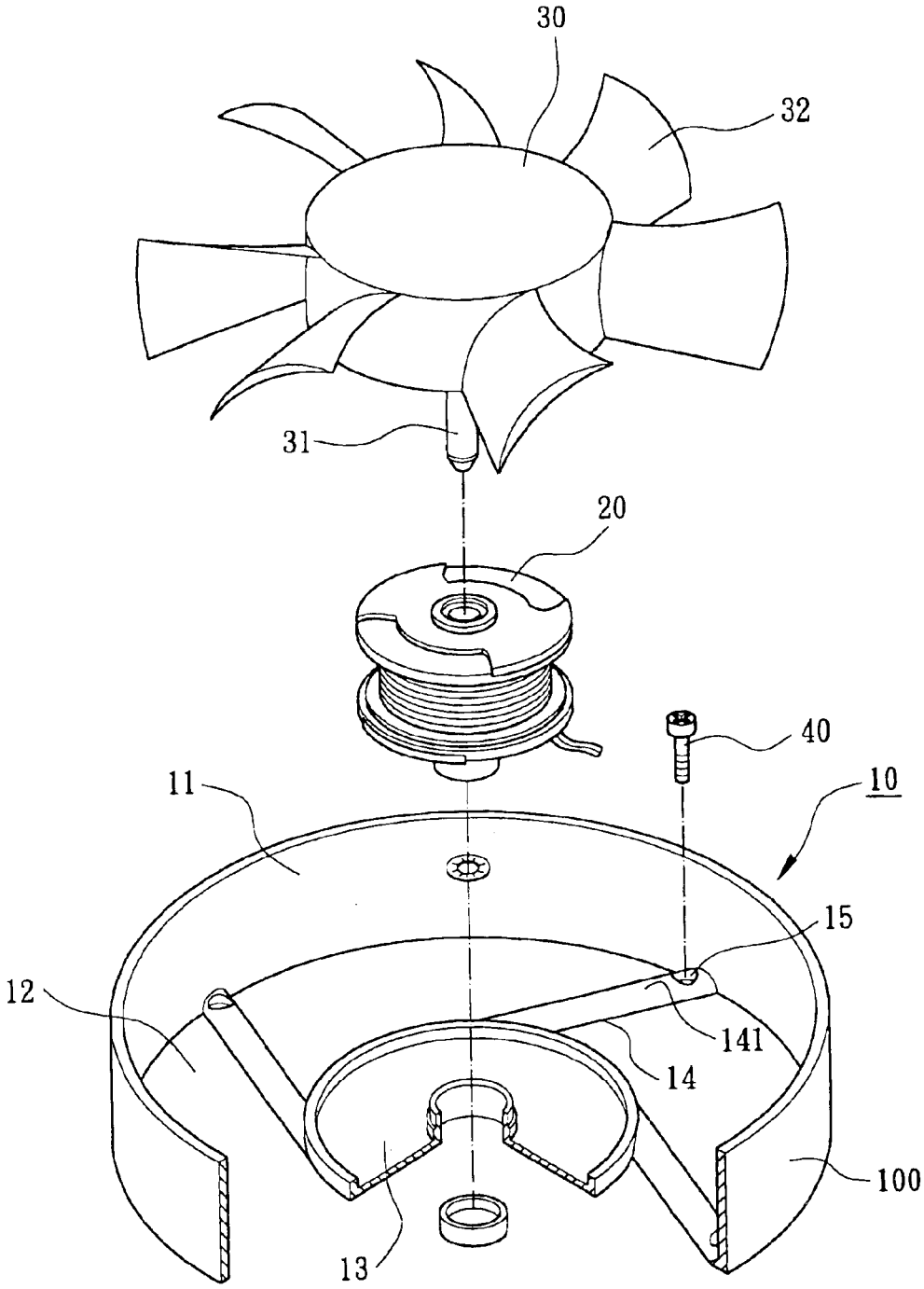
FIG. 9 is an exploded perspective view, partly cutaway, of a fifth embodiment of the heat-dissipating fan in accordance with the present invention.

FIG. 9 illustrates a fifth embodiment of the heat-dissipating fan in accordance with the present invention. In this embodiment, each rib 14 includes an arcuate face 141 in an air inlet side thereof. The arcuate face 141 of each rib 14 provides an improved air-guiding effect and mitigates and/or obviates the air turbulent problem occurred as a result of formation of the respective mounting portion 15.

Figure 10:
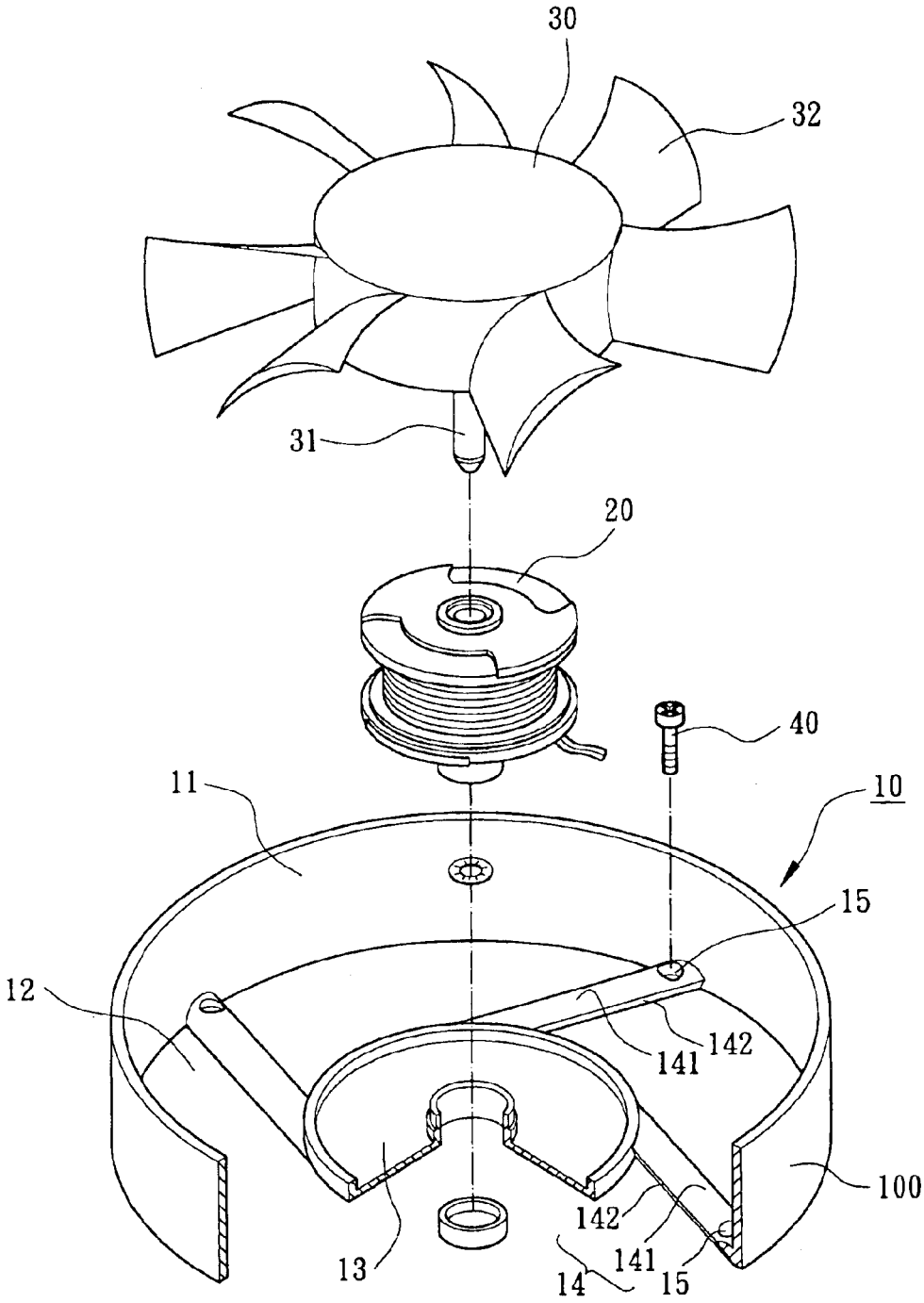
FIG. 10 is an exploded perspective view, partly cutaway, of a sixth embodiment of the heat-dissipating fan in accordance with the present invention.

FIG. 10 illustrates a sixth embodiment of the heat-dissipating fan modified from the embodiment of FIG. 9. In this embodiment, in addition to the arcuate face 141, each rib 14 further includes an inclined side face 142 extending in a direction opposite to that of the blades 32. Thus, when the blades 32 turn to drive air, the arcuate faces 141 and the inclined side faces 142 of the ribs 14 provide an improved air-guiding effect and mitigate and/or obviate the air turbulent problem occurred as a result of formation of the respective mounting portion 15.

Figure 11:
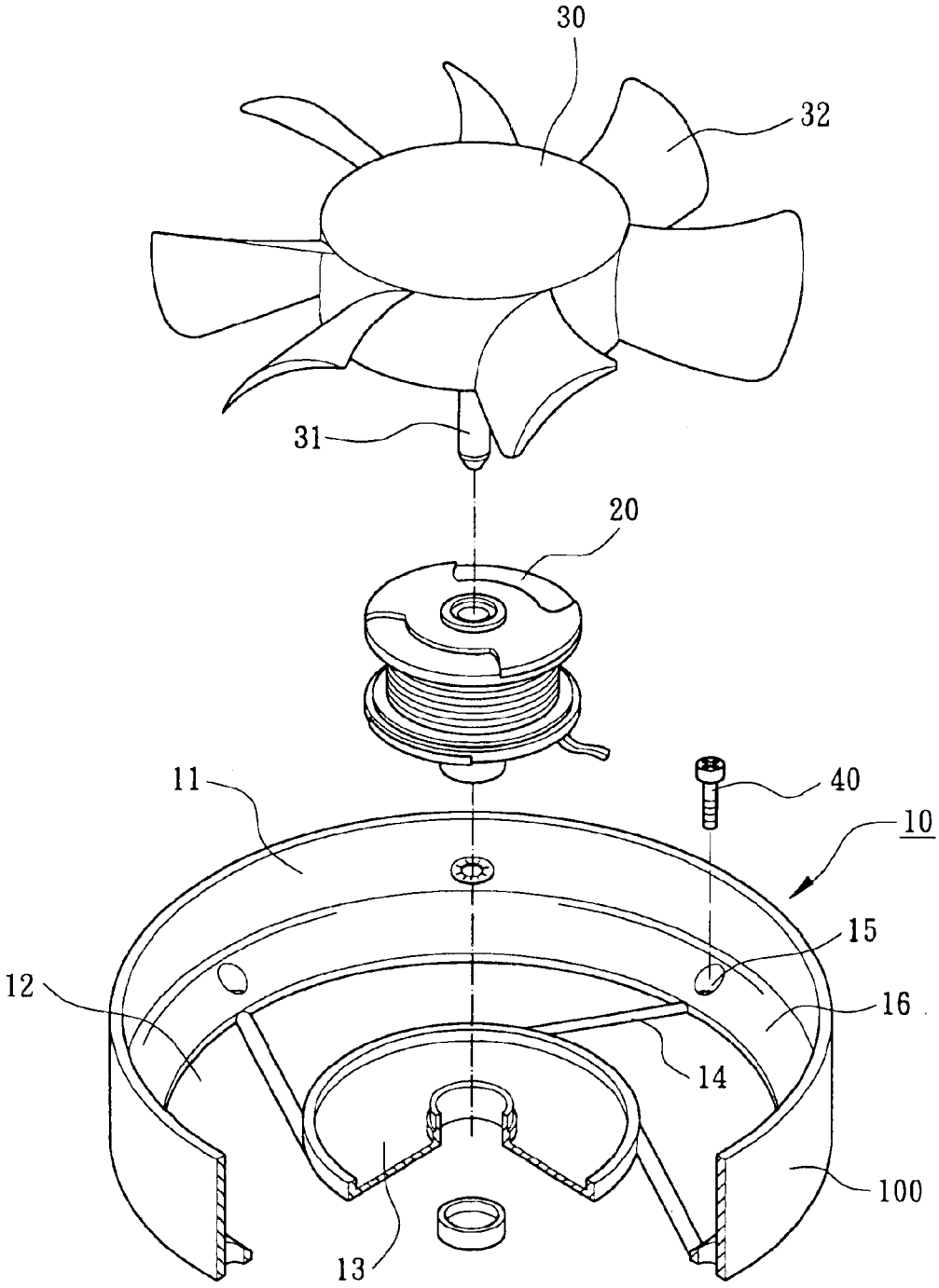
FIG. 11 is an exploded perspective view, partly cutaway, of a seventh embodiment of the heat-dissipating fan in accordance with the present invention.
Figure 12:
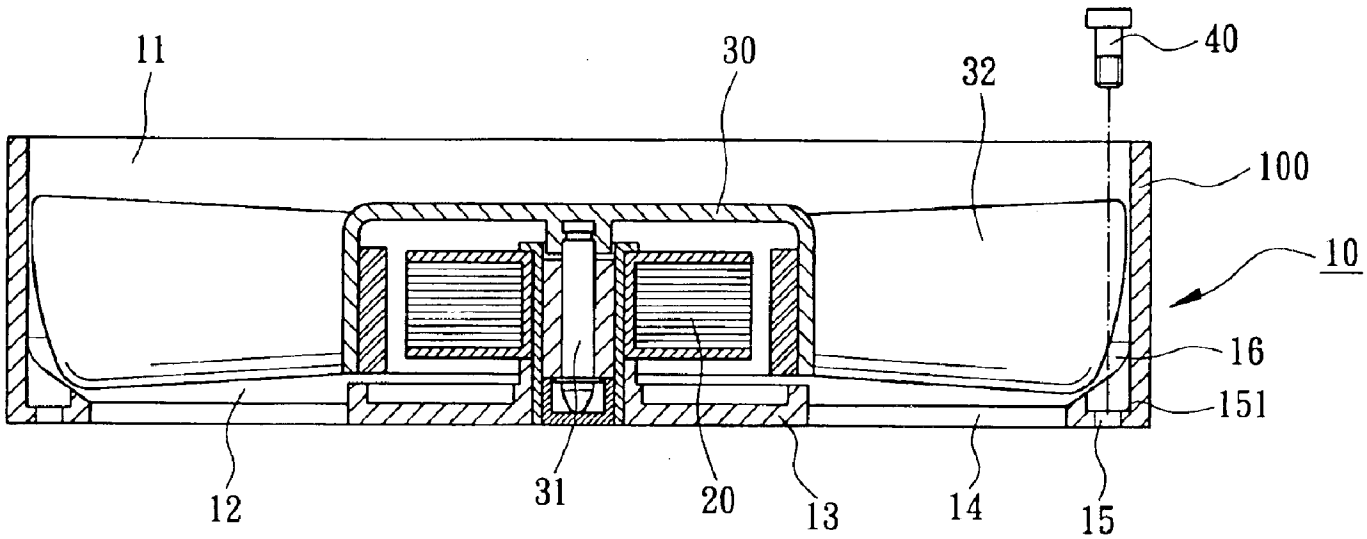

FIGS. 11 and 12 illustrate a seventh embodiment of the heat-dissipating fan in accordance with the present invention. In this embodiment, the annular wall 100 includes an inner annular air-guiding ledge 16 extending inward from an inner periphery thereof. An outer end of each rib 14 is connected to the inner annular air-guiding ledge 16 that guides air from the air inlet side to the air outlet side of the casing 10. The mounting portions 15 are directly formed on the inner annular air-guiding ledge 16. Preferably, the outer edge of each blade 32 is as close to the inner periphery of the annular wall 100 as possible. The inner annular air-guiding ledge 16 provides an improved air-guiding effect and mitigates and/or obviates the air turbulent problem occurred as a result of formation of the respective mounting portion 15.

Figure 13:
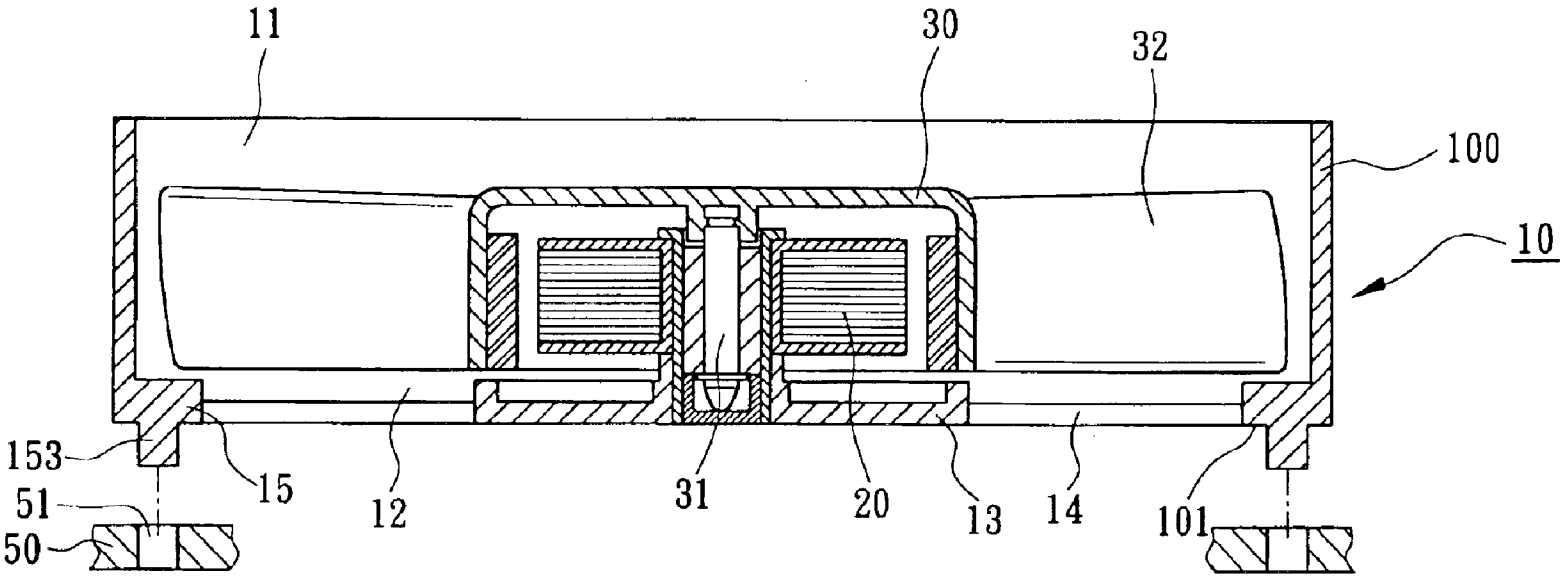
FIG. 13 is a sectional view illustrating an eighth embodiment of the heat-dissipating fan in accordance with the present invention.

FIG. 13 illustrates an eighth embodiment of the heat-dissipating fan in accordance with the present invention. In this embodiment, the casing 10 includes an annular wall 100 and a bottom wall 101, and each mounting portion 15 is in the form of a peg 153 extending outward from the bottom wall 101. Each peg 153 is extended through an associated fixing hole 51 of, e.g., a substrate 50 and fixed by means of engaging effect or by glue, allowing the heat-dissipating fan to be rapidly mounted on the substrate 50. The flexibility of assembling and design is thus improved.

Figure 14:
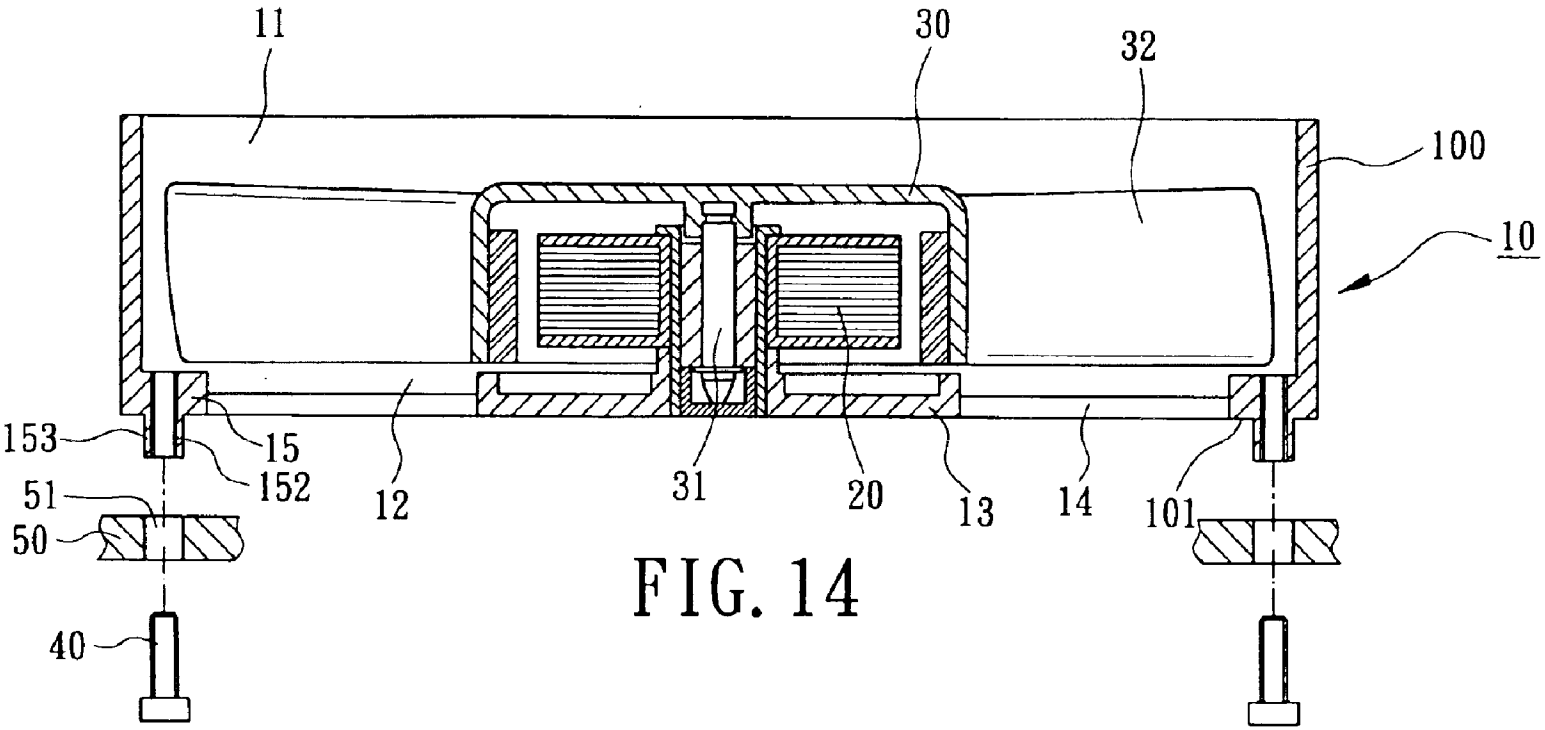
FIG. 14 is a sectional view illustrating a ninth embodiment of the heat-dissipating fan in accordance with the present invention.

FIG. 14 illustrates a ninth embodiment of the heat-dissipating fan in accordance with the present invention. In this embodiment, a through-hole 152 extends through each peg 153 and the bottom wall 101 of the casing 10. Each peg 153 is extended through an associated fixing hole 51 of, e.g., a substrate 50. A fastener 40 is threadedly engaged in each through-hole 152. The flexibility of assembling and design is thus improved.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A casing for a heat-dissipating fan, comprising:

an annular wall including an air inlet in a first end thereof and an air outlet in a second end thereof;

a base securely mounted in the air inlet of the base;

a plurality of ribs each extending between the annular wall and the base; and a plurality for mounting portions provided between the annular wall and the base, the mounting portions being integrally formed on respective ribs for allowing the heat-dissipating fan to be fixed to an object.

2. The casing for a heat-dissipating fan as claimed in claim 1, wherein each said mounting portion is located in an adjoining area between a respective said rib and the annular wall.

3. The casing for a heat-dissipating fan as claimed in claim 2, further comprising a stator securely mounted to the base and a rotor rotatably mounted to the stator, the rotor including a plurality of blades, each said blade having a cutout in an underside of an outer edge thereof.

4. The casing for a heat-dissipating fan as claimed in claim 1, wherein each said mounting portion is located in an adjoining area between a respective said rib and the base.

5. The casing for a heat-dissipating fan as claimed in claim 1, wherein the annular wall includes an inner annular air-guiding ledge extending inward from an inner periphery thereof for guiding air from the air inlet side to the air outlet side, the mounting portions being integrally formed on the inner annular air-guiding ledge.

6. The casing for a heat-dissipating fan as claimed in claim 1, wherein each said mounting portion is a through-hole for engaging with a fastener.

7. The casing for a heat-dissipating fan as claimed in claim 6, wherein each said through-hole includes a threaded portion.

8. The casing for a heat-dissipating fan as claimed in claim 6, wherein each said through-hole includes an enlarged portion.

9. The casing for a heat-dissipating fan as claimed in claim 1, wherein the casing further includes a bottom wall, each said mounting portion extending outward from the bottom wall for engaging with a fixing hole of a substrate.

10. The casing for a heat-dissipating fan as claimed in claim 9, wherein a through-hole extends through each said peg and through the bottom wall of the casing.

11. The casing for a heat-dissipating fan as claimed in claim 1, wherein each said rib includes an arcuate face on an air inlet side thereof, and wherein the mounting portions are integrally formed on the respective ribs.

12. The casing for a heat-dissipating fan as claimed in claim 11, wherein each said rib further includes an inclined side face extending in a direction opposite to that of the blades.

* * * * *